US007954896B2

(12) United States Patent
Selbekk et al.

(10) Patent No.: US 7,954,896 B2
(45) Date of Patent: Jun. 7, 2011

(54) CHAIR SEAT WITH MUTUALLY MOVEABLE PARTS

(75) Inventors: Tormod Selbekk, Trondheim (NO); Kristine Holbo, Trondheim (NO)

(73) Assignee: Sinvent AS, Trondheim (NO)

( * ) Notice: Subject to any disclaimer, the term of this patent is extended or adjusted under 35 U.S.C. 154(b) by 4 days.

(21) Appl. No.: 11/596,522

(22) PCT Filed: May 13, 2005

(86) PCT No.: PCT/NO2005/000163

§ 371 (c)(1), (2), (4) Date: Oct. 1, 2008

(87) PCT Pub. No.: WO2005/110156

PCT Pub. Date: Nov. 24, 2005

(65) Prior Publication Data

US 2009/0039686 A1 Feb. 12, 2009

(30) Foreign Application Priority Data

May 14, 2004 (NO) ..... 20042020

(51) Int. Cl.
*A47C 7/14* (2006.01)

(52) U.S. Cl. ..... 297/284.3

(58) Field of Classification Search ..... 297/284.3, 297/284.1, 107, 201, 452.4, 284.9, 257, 248, 297/284.11, 440.13, 215.14, 423.2, 423.36, 297/440.24, 195.1, 215.13, 351, 350, 440.14, 297/195.11, 233, 411.35, 202, 344.18, 344.1; 108/53

See application file for complete search history.

(56) References Cited

U.S. PATENT DOCUMENTS

| | | | | |
|---|---|---|---|---|
| 270,273 | A * | 1/1883 | Yount | 297/233 |
| 620,946 | A * | 3/1899 | Meisselbach | 297/202 |
| 629,956 | A * | 8/1899 | Craig | 297/201 |
| 2,087,574 | A * | 7/1937 | Kaufer | 297/113 |
| 3,568,972 | A * | 3/1971 | Sherman | 248/419 |
| 5,029,941 | A | 7/1991 | Twisselmann | |
| 5,735,573 | A * | 4/1998 | Vredevoogd | 297/257 |
| 6,554,355 | B2 * | 4/2003 | Kaptur | 297/195.1 |
| 6,824,220 | B1 * | 11/2004 | Davison | 297/440.14 |

FOREIGN PATENT DOCUMENTS

| | | |
|---|---|---|
| JP | 60-74653 | 5/1985 |
| JP | 61-60861 | 4/1986 |
| JP | 1-131348 | 9/1989 |
| JP | 10-151033 | 6/1998 |
| KR | 2003061734 | 7/2003 |
| NO | 178483 | 1/1996 |
| NO | 180221 | 12/1996 |
| WO | 0126508 | 4/2001 |
| WO | WO03/034870 | 5/2003 |
| WO | 2004110218 | 12/2004 |

OTHER PUBLICATIONS

English Abstract of KR 2003061734 dated Jul. 22, 2003 from corresponding document WO2004110218.

Patent Abstracts of Japan and JPO computer English translation of JP 10-151033 dated Jun. 9, 1998.

* cited by examiner

*Primary Examiner* — Milton Nelson, Jr.
(74) *Attorney, Agent, or Firm* — Ladas & Parry

(57) ABSTRACT

The present invention concerns a chair seat (11) with mutually moveable seat parts (1, 5, 6). The seat parts (1, 5, 6) are mutually shiftable in substantially one and the same first plane. The chair seat is particularly adapted to be used as a chair for surgeons.

13 Claims, 5 Drawing Sheets

CHAIR SEAT WITH MUTUALLY MOVEABLE PARTS

The present invention concerns a divided chair seat where the parts of the seat can be shifted independently of each other in a plane. The chair seat is particularly adapted for surgeons who in many cases must sit and work for several hours in a confined space with considerable precision. The chair seat is designed to be adaptable for many users with dissimilar anatomy and various forms of work.

The chair seat can be adapted for many sitting positions, including partly standing positions, a backward position on the chair with a back supporting the stomach or chest, and an ordinary sitting position.

An example of a chair for surgeons is shown in U.S. Pat. No. 5,029,941 showing a number of support functions and adjustment possibilities, but not a seat as defined in the present claim set.

An example of a three part seat is shown in U.S. Pat. No. 178,483 describing a driver's chair for boats, where a boatman can have an ordinary sitting position, or a somewhat more standing position when the sides of the seat are hinged down and the seat is shaped as a saddle. The threeparted seat includes a fixed mid-section, and two side sections hinged in the mid-section, and that accordingly can be folded down.

Yet another example of a three part seat is shown in U.S. Pat. No. 180,221 showing a seat with hinged front parts making it possible for a user to change sitting position by changing the hip angle.

Accordingly it has not been shown a chair seat with a parted sitting face where the separate parts can be shifted in relation to one another in a plane, substantially parallel to the sitting face of the seat as defined in the present claims. The chair seat may include two, three or more moving seat parts therebetween, shiftable or extendable in substantially one single plane. The seat may furthermore include a transversal frame, and the various parts of the chair seat may be fixed to the transversal frame via the gliding faces. The transversal frame can be adapted to be secured in a chair cylinder.

The parts of the seat may include a right seat part, a center seat part and a left seat part.

The shiftable parts of the seat can be locked to the transversal frame with the locking mechanisms.

The chair seat may be particularly adapted for a chair for surgeons. The chair seat may, however, also be well suited for others, for instance dentists, goldsmiths, boat drivers and other professions where greater flexibility in terms of sitting position may be advantageous.

Short description of the enclosed drawings.

DETAILED DESCRIPTION OF EMBODIMENTS OF THE PRESENT INVENTION

Figure 1:
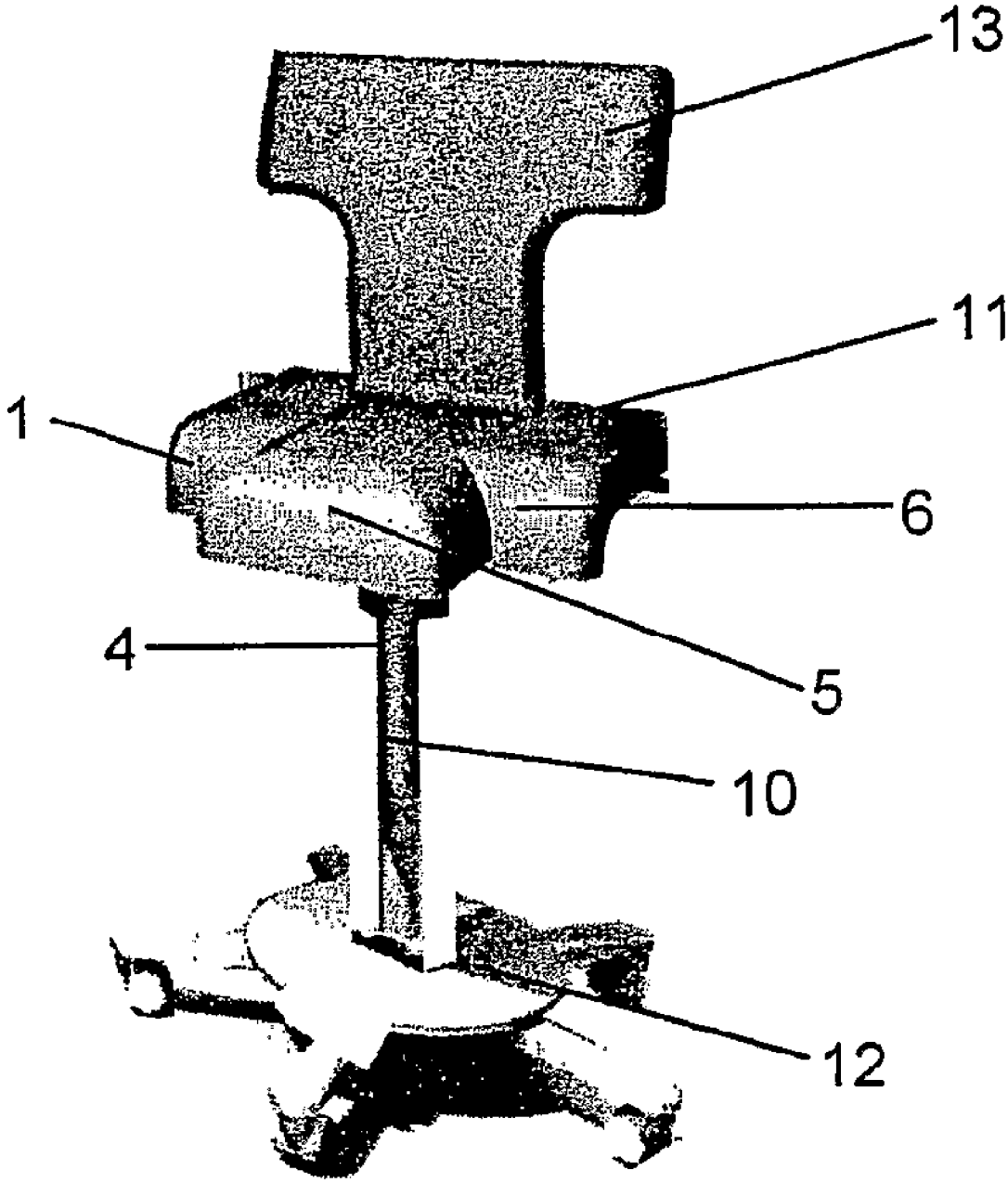
FIG. 1 is a perspective view of an embodiment of a chair with a seat according to the invention.

From FIG. 1 it is shown a chair 10 with a frame 12, a chair back 13 and a seat 11 according to the invention. From the figure it is shown center seat part 5 with a saddle shape in an extended position such that the chair seat 11 is in a configuration that is adapted for partly standing position. Furthermore, it is shown how the left seat part 6 and the right seat part 1 are shaped with shape adapted to the center seat part 5 where the faces of the seat parts face each other. A chair cylinder 4 with a height adjustment is shown between the chair seat 11 and the frame 12.

Figure 2:
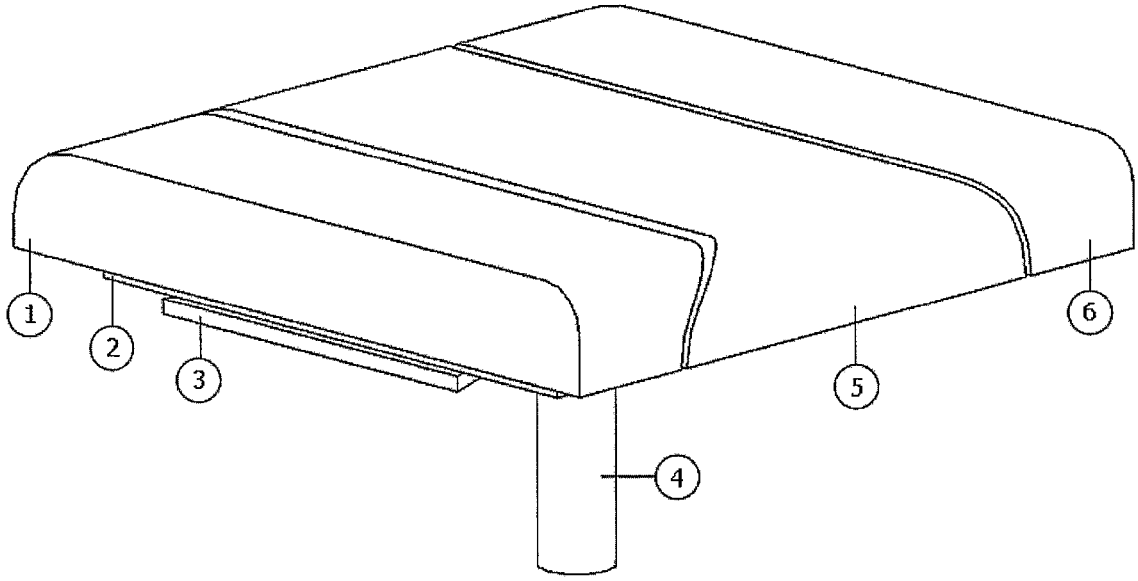
FIG. 2 is a perspective view of an embodiment of a seat according to the invention, where the parts of the seat are in a first position.

From FIG. 2 it is shown a chair seat according to one embodiment of the invention, where a right seat part 1, a center seat part 5 and a left seat part 6 are mounted to a transversal frame 3. The transversal frame may be secured to a chair cylinder 4. The chair cylinder 4 may be connected to an ordinary chair chas-sis in a way otherwise well known within the field as shown on FIG. 1.

The seat parts can be adjusted in the longitudinal direction on the transversal frame 3 through gliding faces 2. The center seat part 5 may have sides formed as a bow, such that when the center part 5 is led forward, and/or when the right seat part 1 and the left seat part 6 are led backwards, the center seat part 5 will form the approximate saddle shape shown on the other figures. Also in the this figure it is shown how the right seat part 1 and the left seat part 6 are shaped with a shape adapted to the saddle shape of the mid-part, such that it is not created substantial recesses in the seat when this is placed in a initial position where the three seat parts are placed side by side without being shifted or extended in relation to each other.

Figure 3:
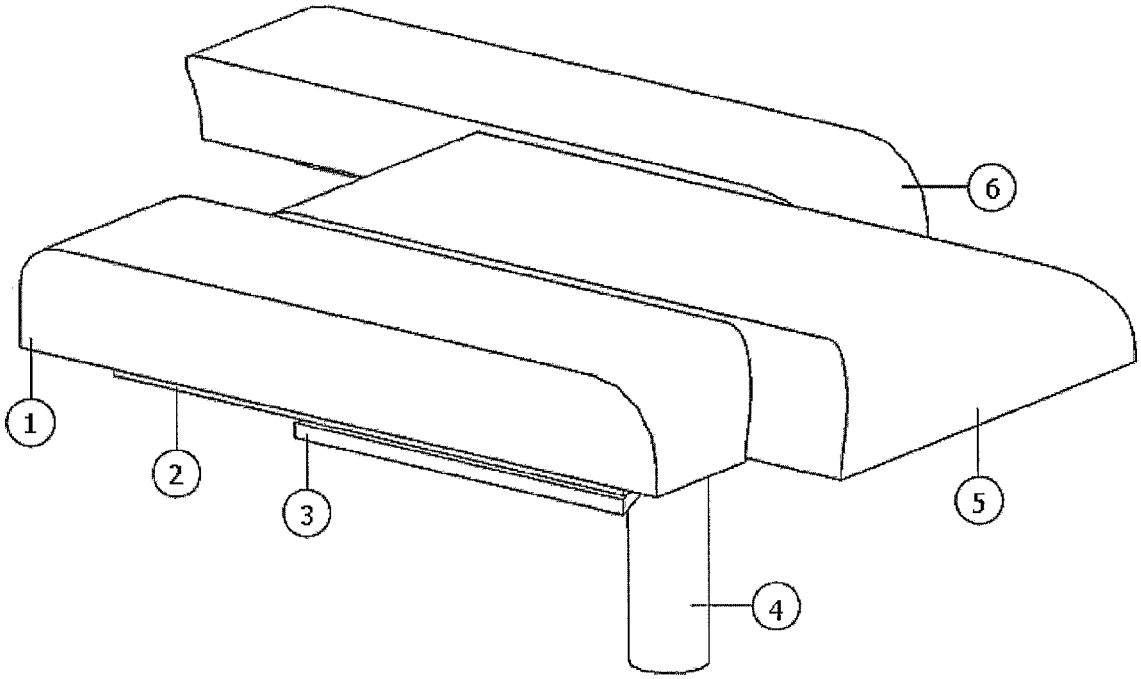
FIG. 3 is perspective view of the embodiment of the seat shown on FIG. 2 where the parts of the seat are in a second position.

From FIG. 3 it is shown the seat of FIGS. 1 and 2, but where the right seat part 1 is retracted somewhat in relation to the transversal frame 3 allowing the right gliding face 2. The grounded sides of the center seat part are clearly shown. The left seat part 6 is shifted backwards, considerably further than the right seat part 1. From the figure it is shown how the right seat part, the center seat part 5 and the left seat part 6 can be shifted in a plane, independently of each other.

Figure 4:
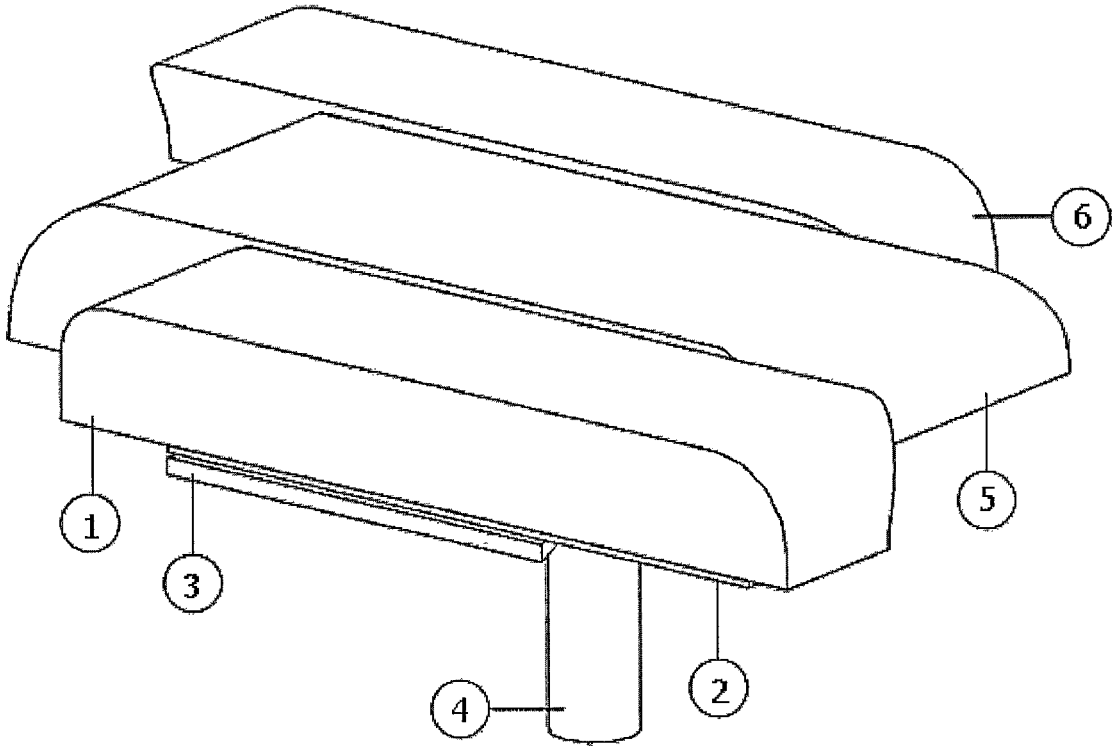
FIG. 4 is a perspective view of the embodiment of the seat shown on FIG. 2 where the parts of the seat are in a third position.

From FIG. 4 the seat from FIGS. 1, 2 and 3 is shown, but where the right seat part 1 is extended forward in relation to the transversal frame 3 along the right gliding face 2. The left seat part 6 is shifted backwards. Also from FIG. 4 it is shown how the right seat part 1, the center seat part 5 and the left seat part 6 can be shifted in a plane, independently of each other.

Figure 5:
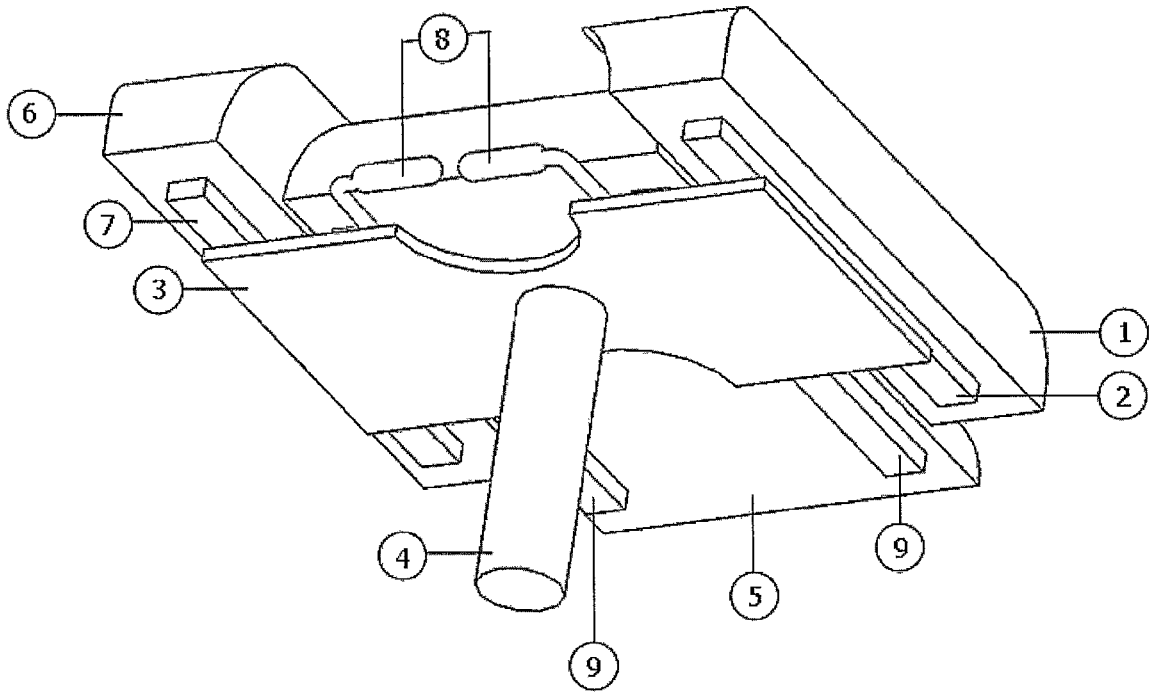
FIG. 5 is a perspective view of the seat shown on FIGS. 1 and 2 seen from below, and where the parts of the seat are in a fourth position.

From FIG. 5 it is shown the underside of the seat, where the right seat part 1, is attached to the transversal frame 3 by the right gliding face 2. The center seat part 5 is secured to the transversal frame 3 with the center gliding faces 9. The left seat part 6 is attached to the transversal frame 3 by the left gliding face 7. The gliding faces 2, 7 and 9 can be guiding rails, well known within the field, and can be of any type. Locking handles 8 are shown placed behind the center seat part 5. Locking handles 8 are provided to be able to lock the seat parts 1, 5, 6 in their desired positions. Right and left seat parts 1, 6 can be connected such that these can be led back and forth with only one handle.

In an alternative embodiment, the center seat part 5 is fixed in the transver-sal frame 3, whereas the left and right seat parts 1, 6 can be shifted back and forth in relation to the center seat part 5 and the transversal frame 3. Alternatively, the left and right seat parts 1, 6 can be fixed to the transversal frame 3, and the center seat part 5 can be slideably mounted on the transversal frame 3. This solution is, however, the least flexible, as the seat parts 1 and 6 cannot be independently adjusted.

The locking mechanism that is controlled by the locking handles 8 may be of any kind, for instance based on lugs going into recesses in the respective elements, or be an infinitely variable friction mechanism.

The locking handles 8 are preferably placed at the back of the chair seat, such that these can be operated by assisting personnel, such that a surgeon does not have to touch these. This is to maintain the hands of the surgeon sterile.

Transversal seat frame 3 can be a simple plate with the gliding faces, guides or rails 2, 7, 9 fixed thereto. Alternatively, the seat frame 3 can be a suitable frame, fixture or some other suitable contraption for fixing the gliding faces 2, 7, 9.

The shown chair 10 is both suitable as an office chair and as a chair that is suitable for a high sitting position or as a standing chair. In neurological operations the surgeon may prefer a tall sitting position for some operations and a lower position for other operations. To sit comfortably in partly standing tall positions the seat should have less support for the thighs, for example a saddle shape, whereas for low and more normal sitting positions it is common to need more support for the thighs. The shown seat can be adjusted and transformed such that the sitting face is optimised for all sitting positions.

The adjustment of the sitting face can in alternative embodiments be per-formed electromechanically, electronically, pneumatically, hydraulically or in a combination of these.

The chair seat is preferably intended used in connection with a chair with a chair back and an undercarriage, well known within the field.

The chair is adapted for various sitting positions, and accordingly the chair undercarriage will normally be of a type with adjustable height.

The chair seat is shown parted in three parts, but the seat may be made with several seat parts, for instance four or five. It is also possible to make an embodiment with only two parts, where one of the parts includes a saddle shape, and the other part has a shape adapted to the saddle shape. This configuration will, however, be less advantageous because it will result in an asymmetrical sitting position on the chair when the saddle part is extended forwards. The embodiment shown on the figures with three parts is chosen because the balance of the chair easily can be accommodated for, and at the same time full flexibility is maintained.

The invention claimed is:

1. A chair seat comprising:

a transversal frame; and a plurality of moveable seat parts including a right, a center and a left moveable seat part, the moveable seat parts being dimensioned to form a seating surface for supporting a single person thereon, the chair seat defining a first plane substantially parallel to a seat face of the seat, wherein the movable seat parts are moveably secured to the transversal frame by gliding faces such that the moveable seat parts are moveable independently with respect to one another in a longitudinal direction of the chair seat and substantially in the first plane, between a first position where the movable seat parts are aligned with each other in the longitudinal direction to form a substantially flat front surface across the moveable seat parts and a second position where the center seat part projects forwards in relation to the left and right seat parts in the longitudinal direction, and the center seat part has rounded sides, and each of the left and right seat parts has a side adjacent to the center seat part that extends toward the center seat part to conform to a curvature of the rounded sides of the center seat part.

2. The chair seat of claim 1, further comprising a chair back secured to the transversal frame.

3. The chair seat of claim 1, wherein the transversal frame is secured to a chair cylinder.

4. The chair seat of claim 1, further comprising a locking mechanism for locking the moveable seat parts to the transversal frame.

5. A chair seat comprising:

a frame; and a plurality of moveable seat parts including a right, a center and a left-moveable seat part, the moveable seat parts being dimensioned to form a seating surface for supporting a single person thereon, the chair seat defining a first plane substantially parallel to a seat face of the seat, wherein the movable seat parts are moveably secured to the frame such that the moveable seat parts are independently moveable with respect to one another in a longitudinal direction of the chair seat and substantially in the first plane, between a first position where the movable seat parts are aligned with each other in the longitudinal direction to form a substantially flat front surface across the moveable seat parts and a second position where the center seat part projects forwards in relation to the left and right seat parts in the longitudinal direction and wherein the center seat part has rounded sides, and each of the left and right seat parts has a side adjacent to the center seat part that extends toward the center seat part to conform to a curvature of the rounded sides of the center seat part.

6. A chair seat adaptable for different sitting positions, the chair seat comprising;

a plurality of seat parts and a single frame for supporting the plurality of seat parts to form a seating surface for supporting a single person thereon;

wherein the seat parts include a left seat part, a center seat part, and a right seat part arranged transversely across the frame;

wherein at least one of the seat parts is movably secured to the frame by gliding means for movement in a plane substantially parallel to the seating surface independent of other of the plurality of seat parts so that the seating surface can be adapted for different sitting positions to support the person thereon; and wherein the center seat part has rounded sides, the left seat part and the right seat part each has a side that extends toward the center seat part to conform to a curvature of an adjacent one of the rounded sides of the center seat part;

wherein all of the plurality of seat parts are independently movably supported on the frame for movement in the plane.

7. A chair seat according to claim 6, wherein the center seat part has two sides that widen from a top surface to a lower surface.

8. A chair seat according to claim 6, wherein the gliding means is a guiding rail.

9. A chair seat according to claim 6, wherein the center seat part is movable between a first position in which the seat parts are aligned with one another to form a substantially flat front surface across all the seat parts and a second position in which the center seat part projects forwards with respect to the left and right seat parts.

10. A chair seat according to claim 6, further comprising a locking mechanism for locking the at least one moveably secured seat part.

11. A chair seat according to claim 6, wherein the center seat part has a saddle shape.

12. A chair seat according to claim 6, wherein the at least one movably secured seat part is slideably supported on the frame.

13. A chair seat according to claim 6, wherein the frame is secured to a chair cylinder.

* * * * *